US010889924B2

(12) United States Patent
Li

(10) Patent No.: US 10,889,924 B2
(45) Date of Patent: Jan. 12, 2021

(54) METHOD FOR MANUFACTURING POLYESTER FILAMENT SPUN-BONDED NON-WOVEN FABRIC

(71) Applicant: Panjin Yu Wang Non-woven Co., Ltd., Liaoning (CN)

(72) Inventor: Jingfeng Li, Liaoning (CN)

( * ) Notice: Subject to any disclaimer, the term of this patent is extended or adjusted under 35 U.S.C. 154(b) by 77 days.

(21) Appl. No.: 16/214,170

(22) Filed: Dec. 10, 2018

(65) Prior Publication Data

US 2019/0271105 A1 Sep. 5, 2019

(30) Foreign Application Priority Data

Mar. 1, 2018 (CN) ..... 2018 1 0172106

(51) Int. Cl.
*D04H 3/16* (2006.01)
*D04H 3/011* (2012.01)

(52) U.S. Cl.
CPC ..... *D04H 3/16* (2013.01); *D04H 3/011* (2013.01); *D10B 2331/04* (2013.01); *D10B 2401/04* (2013.01); *D10B 2401/06* (2013.01)

(58) Field of Classification Search
CPC ..... D04H 3/16; D04H 3/011; D10B 2331/04; D10B 2401/04; D10B 2401/06
See application file for complete search history.

(56) References Cited

PUBLICATIONS

Machine translation of CN 106087255 A; Publication: Nov. 9, 2016.*

* cited by examiner

*Primary Examiner* — Vishal I Patel
(74) *Attorney, Agent, or Firm* — Tsz Lung Yeung

(57) ABSTRACT

A method for manufacturing polyester filament spun-bonded non-woven fabric, comprising, i) drying respectively some polyester chips and black color masterbatch; ii) conveying the dried polyester chips and the dried black color masterbatch to a screw extruder for being melted and compressed into a viscous melt, and making the melt pass through a melt filter to remove impurities; iii) evenly distributing the filtered melt into each metering pump through a spinning manifold, cooling the output melt into filaments, drawing the filaments by airflow and the drawn filaments laying into fiber web, and preliminarily ironing and flattening the fiber web by a needle to obtain a fiber web-reinforced non-woven fabric; iv) winding the non-woven fabric by a winder and then shaping the non-woven fabric by a hot mill to obtain a polyester filament spun-bonded non-woven fabric. The polyester filament spun-bonded non-woven fabric exhibits superior tensile strength are excellent.

10 Claims, No Drawings

METHOD FOR MANUFACTURING POLYESTER FILAMENT SPUN-BONDED NON-WOVEN FABRIC

CROSS-REFERENCE TO RELATED APPLICATION

The present application claims the benefit of Chinese Patent Application No. 201810172106.8 filed on Mar. 1, 2018, the contents of which are hereby incorporated by reference.

TECHNICAL FIELD

The invention relates to the technical field of non-woven fabric, in particular to a method for manufacturing polyester filament spun-bonded non-woven fabric.

BACKGROUND

Non-woven fabric is made up of directional or random fibers. In addition to the features such as moisture resistance, air permeability, flexibility, light weight, non-woven fabric as a new generation of environment-friendly material is not combustion-supporting but decomposable, non-toxic and non-irritant. Moreover, it has such merits as rich color, low price, and good recyclability. Non-woven fabric breaks through the traditional textile principles, and has the characteristics of short technological process, high-speed production, high yield, low cost, and wide application. Furthermore, it is abundant in raw material sources. As a result, non-woven fabric industry has achieved rapid and astonishing development in the last 20 years. Meanwhile, more and more functional non-woven fabrics have been put into use.

Existing polypropylene staple fiber needle-punched non-woven fabric has the following disadvantages: (1) the fragile product has poor physical performance indicators; (2) the product surface is not uniform and displays an uneven thickness; (3) polypropylene fiber does not resist high temperature (melting point: 165 to 173° C.).; (4) due to poor durability and aging resistance of polypropylene fiber, the product becomes brittle and is easy to degrade after a period of service; (5) the product has low production efficiency.

SUMMARY OF THE INVENTION

The invention is to provide a method for manufacturing polyester filament spun-bonded non-woven fabric which has superior tensile strength and other mechanical properties than polypropylene staple fiber needle-punched non-woven fabric.

The technical scheme of the invention is realized by:

A method for manufacturing polyester filament spun-bonded non-woven fabric, characterized in that the polyester filament spun-bonded non-woven fabric is prepared by the following steps:

i) preparation of raw material: polyester chips and black color masterbatch are dried respectively, wherein the polyester chips account for 95-98% and the black masterbatch accounts for 2-5%;

ii) the dried polyester chips and the dried black color masterbatch are conveyed to a screw extruder for being melted and compressed into a viscous melt, and the melt is allowed to pass through a melt filter to remove impurities;

iii) the filtered melt is evenly distributed into each metering pump through a spinning manifold, wherein the spinning manifold maintains 297° C. to 299° C., the metering pump outputs the melt at 9.08-9.11 m/min, the output melt is cooled into filaments under the action of cooling air; the filaments are drawn by airflow and laid into fiber web; and the fiber web is preliminarily ironed and flattened by a pre-pressing roller and repeatedly punched by a needle with a groove on the edge to obtain a fiber web-reinforced non-woven fabric;

iv) the non-woven fabric obtained through the punching process in step iii) is winded by a winder and then shaped by a hot mill to obtain the polyester filament spun-bonded non-woven fabric;

wherein the revolving speed of the screw extruder in step ii) is 40-42 r/min, and the temperature conditions required for melting and compressing are as follows: the screw extruder is divided into a cold zone, zone 1, zone 2, zone 3, zone 4, zone 5, zone 6 and zone 7, wherein the cold zone is 46 to 48° C., zone 1 is 280 to 290° C., zone 2 is 282 to 292° C., zone 3 is 284 to 294° C., zone 4 is 286 to 296° C., zone 5 is 288 to 298° C., zone 6 is 289 to 299° C. and zone 7 is 287 to 297° C. respectively.

Preferably, the laying process in step iii) is as follows: the drawn filaments are dispersed by a swinger and adsorbed onto a transmission mesh, wherein the swinging frequency is 500 to 600 times/min, and the pre-pressing roller is 144 to 146° C.

Preferably, the punching process in step iii) is as follows: the fiber web that has been preliminarily ironed and flattened by the pre-pressing roller is fed into a needling machine and punched by a plurality of felting needles with grooves, so that the fiber web moves up and down and is compressed when approaching; when the grooves reach a certain depth, the felting needles start to rise and the displaced fibers are separated from the grooves and left in the fiber web in a vertical state, which makes the compression generated by the fiber web non-recoverable; after each square centimeter of the fiber web is punched for dozens or hundreds of times, a certain number of fibers are punched into the fiber web; thus the fiber web-reinforced non-woven fabric is obtained with the increasing friction force between fibers in the fiber web.

Preferably, three needling machines are provided in step iii), wherein the first needling machine is used for preliminarily connecting the non-woven fabric, the second needling machine is used for forcibly locking the non-woven fabric, and the third needling machine is used for repairing and flattening the non-woven fabric, wherein the needle types are M222 and C222.

Preferably, the speed of the winder is 10.1-10.3 m/min in step iv).

Preferably, the shaping temperature of the hot mill in step iv) is as follows: the upper roller is 240 to 245° C., and the lower roller is 230 to 235° C.

Preferably, the winding speed of the hot mill is 20-25 m/min in step iv).

Preferably, the drawing pressure of the airflow drawing process in step iii) is 5.2 to 5.6 bar.

Preferably, the side air blasting of the filament cooling process in step iii) requires a temperature of 23 to 25° C., a humidity of 85-87%, and a pressure of 130-140 pa.

Preferably, the drying process of the polyester chips in step i) is as follows: the wet chips are sent to a chip hopper by a conveying system for use in a crystallizer; the wet chips fall into a pulsating bed under gravity through a slide damper of the chip hopper; the crystal chips remain in the crystallizer for 15 to 20 min with a crystallization temperature of 173 to 176° C. and a rotating speed of crystallization fan of 78 r/min; the crystallized chips are continuously and uniformly fed into a primary drying tower, and remain in the primary drying tower for about 4 to 6 hours with a drying temperature of 164 to 166° C. and a dew-point temperature of −89 to −91° C.; for the black color masterbatch, the drying temperature is 130° C. and the drying time is 8 hours.

The beneficial effects of the invention are as follows:

1. Compared with polypropylene staple fiber needle-punched non-woven fabric, the non-woven fabric of the present invention exhibits obvious superior tensile strength and tearing strength tested according to the American standards ASTM D5034 and ASTM D5733.

The polyester filament spun-bonded non-woven fabric of the present invention has the advantages of high production efficiency, large production capacity and relatively low price.

DETAILED DESCRIPTION OF THE PREFERRED EMBODIMENT

The invention relates to a polyester filament spun-bonded non-woven fabric for automobile seats, comprising the following raw materials in percentage by weight: 95-98% of polyester chips and 2-5% of black color masterbatch.

Example 1

The invention relates to a polyester filament spun-bonded non-woven fabric for automobile seats, which comprises the following raw materials in percentage by weight: 98% of polyester chips and 2% of black color masterbatch. The polyester filament spun-bonded non-woven fabric is prepared by the following method:

i) Preparation of raw materials, i.e., drying of polyester chips: the wet polyester chips are sent to a chip hopper by a conveying system for use in a crystallizer; the wet chips fall into a pulsating bed under gravity through a slide damper of the chip hopper; the crystal chips remain in the crystallizer for 15 to 20 min with a crystallization temperature of 173 to 176° C. and a rotating speed of crystallization fan of 78 r/min; the crystallized chips are continuously and uniformly fed into a primary drying tower, and remain in the primary drying tower for about 4 to 6 hours with a drying temperature of 164 to 166° C. and a dew-point temperature of −89 to −91° C.

Drying of black color masterbatch: the black color masterbatch is dried 8 hours in a dryer with a drying temperature of 130° C.

ii) The dried polyester chips and the dried black color masterbatch are conveyed to a screw extruder for being melted and compressed into a viscous melt, and the melt is allowed to pass through a melt filter to remove impurities; wherein the revolving speed of the screw extruder is 40-42 r/min, and the temperature conditions required for melting and compressing are as follows: the screw extruder is divided into a cold zone, zone 1, zone 2, zone 3, zone 4, zone 5, zone 6 and zone 7, wherein the cold zone is 46 to 48° C., zone 1 is 280 to 290° C., zone 2 is 282 to 292° C., zone 3 is 284 to 294° C., zone 4 is 286 to 296° C., zone 5 is 288 to 298° C., zone 6 is 289 to 299° C. and zone 7 is 287 to 297° C. respectively.

iii) The filtered melt is evenly distributed into each metering pump through a spinning manifold, the metering pump outputs the melt at 9.08-9.11 m/min, and the output melt is cooled into filaments under the action of side air blasting; the filaments are drawn by airflow and laid into fiber web; the fiber web is repeatedly punched by a needle with a groove on the edge to obtain a fiber web-reinforced non-woven fabric; wherein the drawing pressure in the airflow drawing process is 5.2 to 5.6 bar;

wherein, specific process parameters of the spinning manifold are provided in Table 1.

TABLE 1

Specific process parameters of spinning manifold

| Process item | Unit | Scope |
|---|---|---|
| Manifold temperature | ° C. | 297-299 |

The laying into fiber web process is as follows: the drawn filaments are dispersed by a swinger and adsorbed onto a transmission mesh and compressed by a pre-pressing roller; wherein the swinging frequency of the swinger is 500 to 600 times/min, and the pre-pressing roller is 144 to 146° C.

The side air blasting of the filament cooling process requires a temperature of 23 to 25° C., a humidity of 85-87%, and a pressure of 130-140 pa.

The specific punching process is as follows: the fiber web that has been preliminarily ironed and flattened by the pre-pressing roller is fed into a needling machine and punched by a plurality of felting needles with grooves, so that the fiber web moves up and down and is compressed when approaching; when the felting needles reach a certain depth, the felting needles start to rise; since the felting needles move clockwise, the displaced fibers are separated from the grooves and left in the fiber web in a vertical state, just like many fibers are pinned into the fiber web, which makes the compression generated by the fiber web non-recoverable; after each square centimeter of the fiber web is punctured for dozens or hundreds of times, a certain number of fibers are punctured into the fiber web; thus the fiber web-reinforced non-woven fabric is obtained with the increasing friction force between fibers in the fiber web and the increasing density and strength of the fiber web. In this process, three needling machines are provided. The first needling machine is used for preliminarily connecting the non-woven fabric, the second needling machine is used for forcibly locking the non-woven fabric, and the third needling machine is used for repairing and flattening the non-woven fabric, wherein the needle types are M222 and C222. See Table 2 for specific needling parameters.

TABLE 2

Needling parameters

| Process item | Unit | Scope |
|---|---|---|
| ① Needling density | c/cm$^2$ | 26-28 |
| ① Needling density | mm | 9.3-9.5 |
| ② Needling density | c/cm$^2$ | 34-36 |
| ② Needling density | mm | 3.49-3.52 |
| ③ Needling density | c/cm$^2$ | 2.5-2.6 |
| ③ Needling density | mm | 40-42 |

iv) The non-woven fabric obtained through the punching process in step 3) is winded by a winder and then shaped by a hot mill to obtain a polyester filament spun-bonded non-woven fabric; wherein the speed of the winder is 10.1-10.3 m/min. The shaping temperature of the hot mill is as follows: the upper roller is 240 to 245° C., and the lower roller is 230 to 235° C.

Example 2

The invention relates to a polyester filament spun-bonded non-woven fabric for automobile seats, which comprises the following raw materials in percentage by weight: 95% of polyester chips and 5% of black color masterbatch; and the preparation method of the polyester filament spun-bonded non-woven fabric is the same as that of example 1.

Test Example

Tensile strength, heat resistance and aging resistance of the polyester filament spun-bonded non-woven fabric for automobile seats of the present invention are tested according to American standards ASTM D5034 and ASTM D5733. The results are provided in Table 3.

TABLE 3

Performance test results of polyester filament spun-bonded non-woven fabric of the present invention

| Item | Example 1 | Example 2 | Polypropylene staple fiber needle-punched non-woven fabric | Test standard |
|---|---|---|---|---|
| Tensile strength | Axial: 700N; Lateral: 600N | Axial: 710N; Lateral: 610N | Axial: 500N Lateral: 400N | ASTM D5034 |
| Heat resistance | Melting point: 168-174° C. | Melting point: 168-174° C. | Melting point: 265° C. | |
| Aging resistance | Strong | Strong | Strong | |

The above embodiments are only preferred embodiments of the invention which are not used to limit the invention. Any modification, equivalent replacement and improvement made within the range of the spirit and rule of the invention shall be incorporated into the protection range of the invention.

The invention claimed is:

1. A method for manufacturing polyester filament spun-bonded non-woven fabric, wherein the polyester filament spun-bonded non-woven fabric is prepared by the following steps:

i) preparation of raw material: drying some polyester chips and black color masterbatch respectively, wherein the polyester chips account for 95-98% and the black masterbatch accounts for 2-5%;

ii) conveying the dried polyester chips and the dried black color masterbatch to a screw extruder for being melted and compressed into a viscous melt, and making the melt pass through a melt filter to remove impurities and obtain filtered melt;

iii) evenly distributing the filtered melt into each metering pump through a spinning manifold, wherein the spinning manifold maintains 297° C. to 299° C., the metering pump outputs the melt at 9.08-9.11 m/min, cooling the output melt into filaments under the action of cooling air; drawing the filaments by airflow to obtain drawn filaments and laying the drawn filaments into fiber web; and preliminarily ironing and flattening the fiber webby a pre-pressing roller and then repeatedly punching the fiber web by a needle with a groove on the edge to obtain a fiber web-reinforced non-woven fabric;

iv) winding the non-woven fabric obtained through the punching process in step by a winder and then shaping the non-woven fabric by a hot mill to obtain the polyester filament spun-bonded non-woven fabric;

wherein a revolving speed of the screw extruder in step ii) is 40-42 r/min, and temperature conditions required for melting and compressing are as follows: the screw extruder is divided into a cold zone, zone 1, zone 2, zone 3, zone 4, zone 5, zone 6 and zone 7, wherein the cold zone is 46 to 48° C., zone 1 is 280 to 290° C., zone 2 is 282 to 292° C., zone 3 is 284 to 294° C., zone 4 is 286 to 296° C., zone 5 is 288 to 298° C., zone 6 is 289 to 299° C. and zone 7 is 287 to 297° C. respectively.

2. The method for manufacturing polyester filament spun-bonded non-woven fabric according to claim 1, wherein the laying process in step iii) is as follows: dispersing the drawn filaments by a swinger and then making the drawn filaments adsorb onto a transmission mesh, wherein the swinging frequency is 500 to 600 times/min, and the pre-pressing roller is 144 to 146° C.

3. The method for manufacturing polyester filament spun-bonded non-woven fabric according to claim 2, wherein the punching process in step iii) is as follows: feeding the fiber web that has been preliminarily ironed and flattened by the pre-pressing roller into a needling machine and punching the fiber web by a plurality of felting needles with grooves, making the fiber web moves up and down and compressing the fiber web when approaching; when the grooves reach a certain depth, the felting needles start to rise and the displaced fibers are separated from the grooves and left in the fiber web in a vertical state, which makes the compression generated by the fiber web non-recoverable; after punching each square centimeter of the fiber web for dozens or hundreds of times, making a certain number of fibers punch into the fiber web; thus obtaining the fiber web-reinforced non-woven fabric with the increasing friction force between fibers in the fiber web.

4. The method for manufacturing polyester filament spun-bonded non-woven fabric according to claim 3, wherein three needling machines are provided in step iii), wherein the first needling machine is used for preliminarily connecting the non-woven fabric, the second needling machine is used for forcibly locking the non-woven fabric, and the third needling machine is used for repairing and flattening the non-woven fabric, wherein the needle types are M222 and C222.

5. The method for manufacturing polyester filament spun-bonded non-woven fabric according to claim 1, characterized in that a speed of the winder is 10.1-10.3 m/min in step iv.

6. The method for manufacturing polyester filament spun-bonded non-woven fabric according to claim 1, characterized in that the shaping temperature of the hot mill in step iv) is as follows: an upper roller is 240 to 245° C., and a lower roller is 230 to 235° C.

7. The method for manufacturing polyester filament spun-bonded non-woven fabric according to claim 1, characterized in that a winding speed of the hot mill is 20-25 m/min in step iv).

8. The method for manufacturing polyester filament spun-bonded non-woven fabric according to claim 1, characterized in that the drawing pressure of the airflow drawing process in step iii) is 5.2 to 5.6 bar.

9. The method for manufacturing polyester filament spun-bonded non-woven fabric according to claim 1, characterized in that side air blasting of the filament cooling process in step iii) requires a temperature of 23 to 25° C., a humidity of 85-87%, and a pressure of 130-140 pa.

10. The method for manufacturing polyester filament spun-bonded non-woven fabric according to claim 1, characterized in that the drying process of the polyester chips in step i) is as follows: sending wet chips to a chip hopper by a conveying system for use in a crystallizer; making the wet chips fall into a pulsating bed under gravity through a slide damper of the chip hopper; the crystal chips remain in the crystallizer for 15 to 20 min with a crystallization temperature of 173 to 176° C. and a rotating speed of crystallization fan of 78 r/min; the crystallized chips are continuously and uniformly fed into a primary drying tower, and remain in the primary drying tower for about 4 to 6 hours with a drying temperature of 164 to 166° C. and a dew-point temperature of −89 to −91° C.; for the black color masterbatch, the drying temperature is 130° C. and the drying time is 8 hours.

* * * * *